United States Patent [19]

Martin

[11] Patent Number: 4,793,615

[45] Date of Patent: Dec. 27, 1988

[54] PUZZLE WITH MOVABLE PIECES

[76] Inventor: John K. Martin, 1093 Elizabethtown Rd., Elizabethtown, Pa. 17022

[21] Appl. No.: 100,908

[22] Filed: Sep. 25, 1987

[51] Int. Cl.[4] ..... A63F 9/08

[52] U.S. Cl. ..... 273/153 S

[58] Field of Search ..... 273/153 S, 281

[56] References Cited

U.S. PATENT DOCUMENTS

| | | | |
|---|---|---|---|
| 205,151 | 6/1878 | Tatham | 273/153 S X |
| 487,318 | 12/1892 | Clarke | 273/153 S |
| 564,846 | 7/1896 | Schmidt | 273/153 S |
| 668,386 | 2/1901 | Moss | 273/153 S |
| 4,424,971 | 1/1984 | Clark | 273/153 S |

FOREIGN PATENT DOCUMENTS

| | | | |
|---|---|---|---|
| 245004 | 12/1925 | United Kingdom | 273/153 S |

*Primary Examiner*—Anton O. Oechsle

[57] ABSTRACT

The puzzle has a single plane base on which are mounted movable puzzle pieces. The pieces are restrained in a fixed series of grooves and can be arranged in a desired pattern. The pieces are scrambled in a random arrangement to be then moved back to the desired pattern.

9 Claims, 3 Drawing Sheets

PUZZLE WITH MOVABLE PIECES

BACKGROUND OF THE INVENTION

The field of the invention is a single plane puzzle with movable pieces the are arranged and rearranged in a fixed series of grooves.

SUMMARY OF THE INVENTION

A board structure is provided with a base having a series of grooves therein. A wall structure is provided on the perimeter of the base and this provided a wall around the area of the base with the grooves. Puzzle pieces are placed on the base with means restraining the puzzle pieces for movement only along the grooves. Movement of the puzzle pieces is in a single plane with the puzzle pieces capable of movement laterally and rotationally within the plane. The puzzle pieces are in a first desired pre-arranged relationship. The puzzle pieces are placed in a second random relationship. The puzzle pieces are held in a single plane and moved only according to the grooves. They must be rotated and/or shifted, one relative another, within open spaces not occupied by another puzzle piece to move the pieces from the random to pre-arranged relationshops.

DETAILED DESCRIPTION OF THE INVENTION

In each embodiment of the invention there is a base that has a series of grooves cut thereinto in a pattern to control the path of movement of the puzzle pieces. The grooves are dovetail grooves or inverted T grooves that will function to hold a post portion of the puzzle piece in the groove so the puzzle piece can not be lifted up above the plane of the puzzle pieces and moved randomly.

Above the base is a wall structure around the edge of the base to form a recessed area above the grooves. The wall retains and guides the movement of the puzzle pieces.

The puzzle pieces are square or triangular in shape and have a post extending downward from the center region thereof into the grooves. With the post retained in the groove, the puzzle piece must follow the path of the groove pattern while rotation of the puzzle pieces around the post are controlled by the wall structure.

Figure 1:
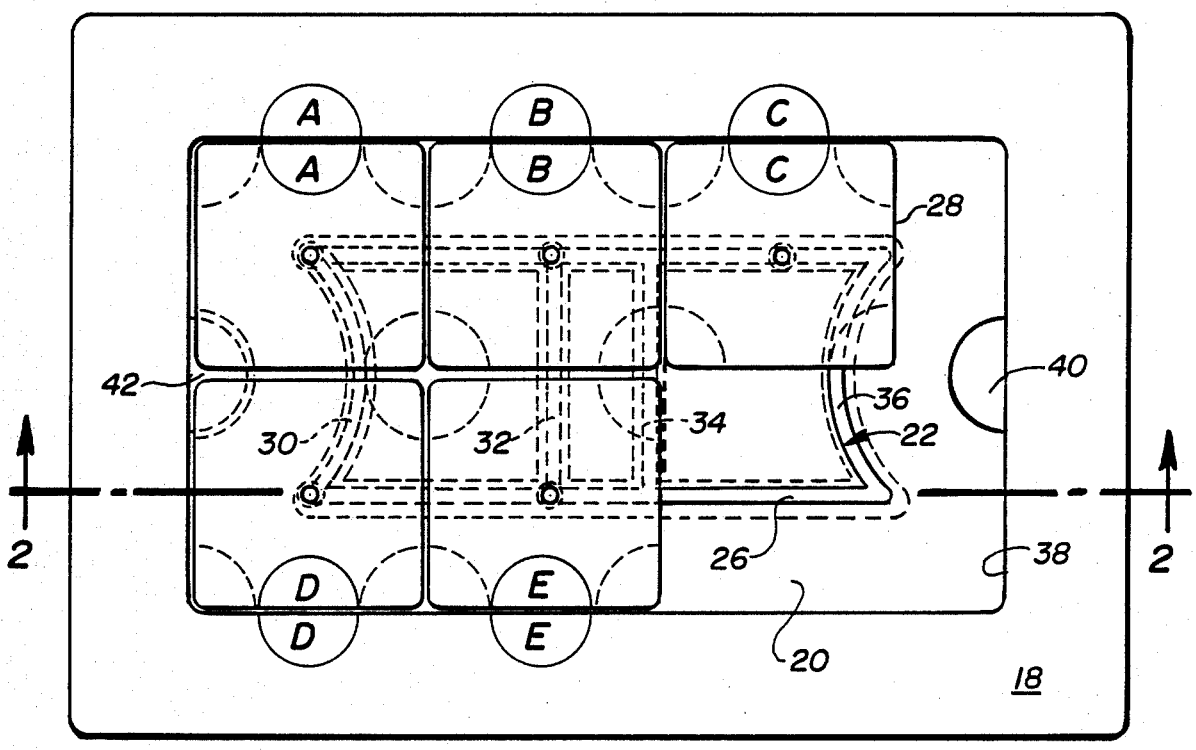
FIG. 1 is a top view of one embodiment of the invention.
Figure 2:
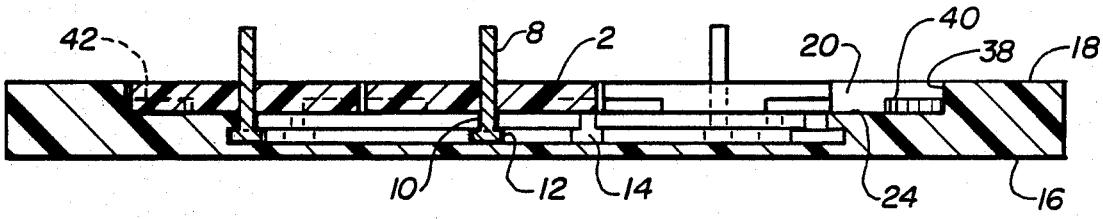
FIG. 2 is a sectional view on line 2—2 of FIG. 1.
Figure 3:
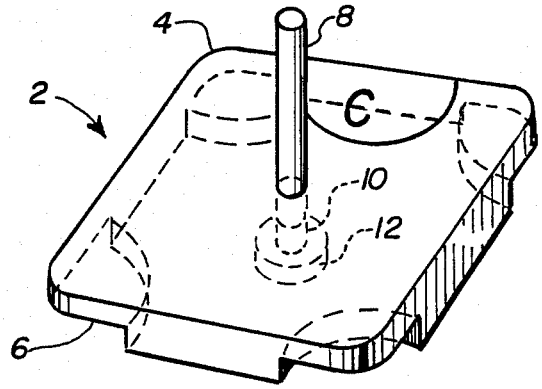
FIG. 3 is a perspective view of a puzzle piece used in the invention.

Referring first to FIG. 1, there are five puzzle pieces A,B,C,D and E. Pieces A,B and C bear the lower half of the circles A,B and C. While pieces D and E bear the upper half of the circles D and E. The puzzle pieces 2 are square, as shown in FIG. 3, with rounded corners 4 and the area 6 under each corner are cut out in a one-quarter circle segment. In the center of each piece 2 there is a post 8 extending partly above the puzzle piece to assist in moving the puzzle piece. A recessed area could replace the post and be engaged by a finger tip to move the piece 2. The post or recess or other structure may function as a means to be engaged to move the puzzle piece 2. Extending below the puzzle piece is part 10 of post 8 and the lower part 10 has an enlarged head 12. In FIG. 2 the groove cross-section 14 is shown as an inverted T shape. It is the enlarged head 12 and groove shape 14 that restrains the puzzle pieces for movement only along the grooves and in a single plane. A dovetail groove or other shaped groove could be used as a means to restrain the puzzle pieces for movement along the series of grooves and only in a single plane.

As shown in FIG. 2, the base 16 of the puzzle has a raised wall 18 around the perimeter thereof. The wall 18 forms a rectangular recessed area 20 and the series of grooves 22 are cut into the base 24 or the bottom of the recessed area. The puzzle pieces are in the recessed area above its base 24 and the recessed area forms the plane that the puzzle pieces are restrained for movement within.

As seen in FIG. 1, some open area exists on the right side and lower right corner of the recess area not occupied by a puzzle piece or parts thereof. This existance of some open area is needed to permit the puzzle pieces to be moved. In the base of the recessed area 20 there is cut a groove pattern of two long parallel grooves 26,28 interconnected with four short grooves 30,32,34,36 of which 32 and 34 are straight and 30,36 are curved. The post part 10 of each of the puzzle pieces is in the pattern or series of grooves 22 and each puzzle piece is capable of movement, provided open area exists, in either direction along the long grooves 26,28. The pieces 2 can not rotate in grooves 26,28 due to the wall side 38 of the wall 18 forming the recessed area 20 holding the puzzle pieces 2. The puzzle pieces can move in either direction along the short grooves 30,32,34,36. Movement in the short straight grooves 32,34 can only be along the grooves and no rotation is possible because the number of puzzle pieces is such that not sufficient open area can be formed on both sides of the straight short grooves to permit rotation 90 degrees of the pieces 2. However, rotation and lateral movement of the pieces 2 will occur when the pieces move along the short, curved grooves 30,36. This rotation is caused by the raised semicircular pieces 40,42 at each end of the recessed area 20.

Figure 4:
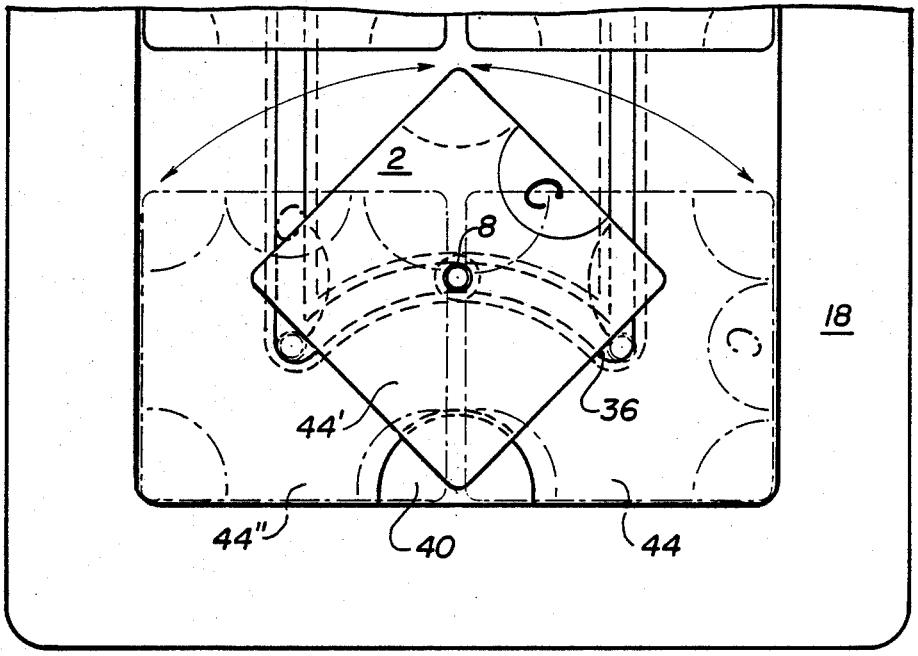
FIG. 4 is a partial view of the embodiment of FIG. 1 showing a puzzle piece in a rotational path of movement.

Referring to FIG. 4, the post 8 moves from the right to the left in groove 36. The puzzle piece moves from dotted line position 44 to solid line position 44', with 45 degrees of rotation, to dotted line position 44'', with 90 degrees of rotation. The rotation of 90 degrees is forced by the raised semicircular piece 40 engaging one of the corner cutout areas 6 to retain the corner while the post part 8 moves along the curved groove 36.

The puzzle pieces 2 are numbered or colored or provided with some means to provide the puzzle pieces with a first desired pre-arranged relationship. The means to provide the pieces with a first desired pre-arranged relationship is broadly a design on the upper exposed surfaces of the puzzle pieces 2. As seen in FIG. 1, the design is a series of matching semicircular areas A,B,C,D,E which form the desired prearranged design when the puzzle pieces are all in only one set position. In use as an entertaining puzzle, the puzzle pieces are moved randomly so that they can be shifted one relative to its position adjacent another and/or rotated to scramble the puzzle pieces from the FIG. 1 relationship to a random relationship. A puzzle player must now selectively move the puzzle pieces back to their desired pre-arranged relationship by a selective movement and/or rotation of each of the puzzle pieces. The puzzle pieces are held in a single plane, move only according to the groove pattern and must be rotated and/or shifted one relative another within the area not occupied by another puzzle piece.

Figure 5:
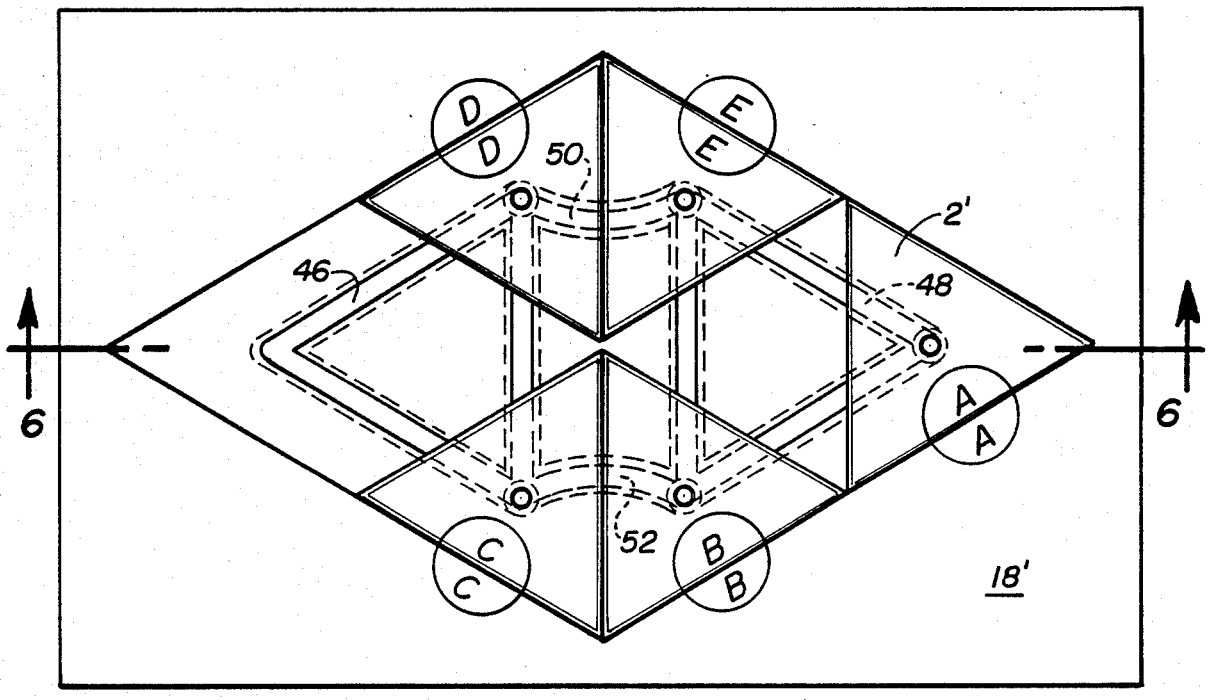
FIG. 5 is a top view of another embodiment of the invention.
Figure 6:
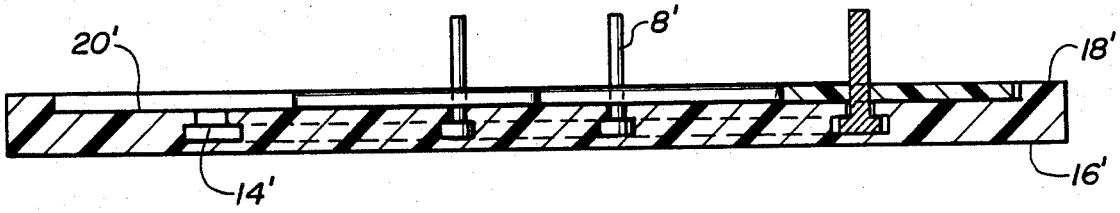
FIG. 6 is a sectional view on line 6—6 of FIG. 5.
Figure 7:
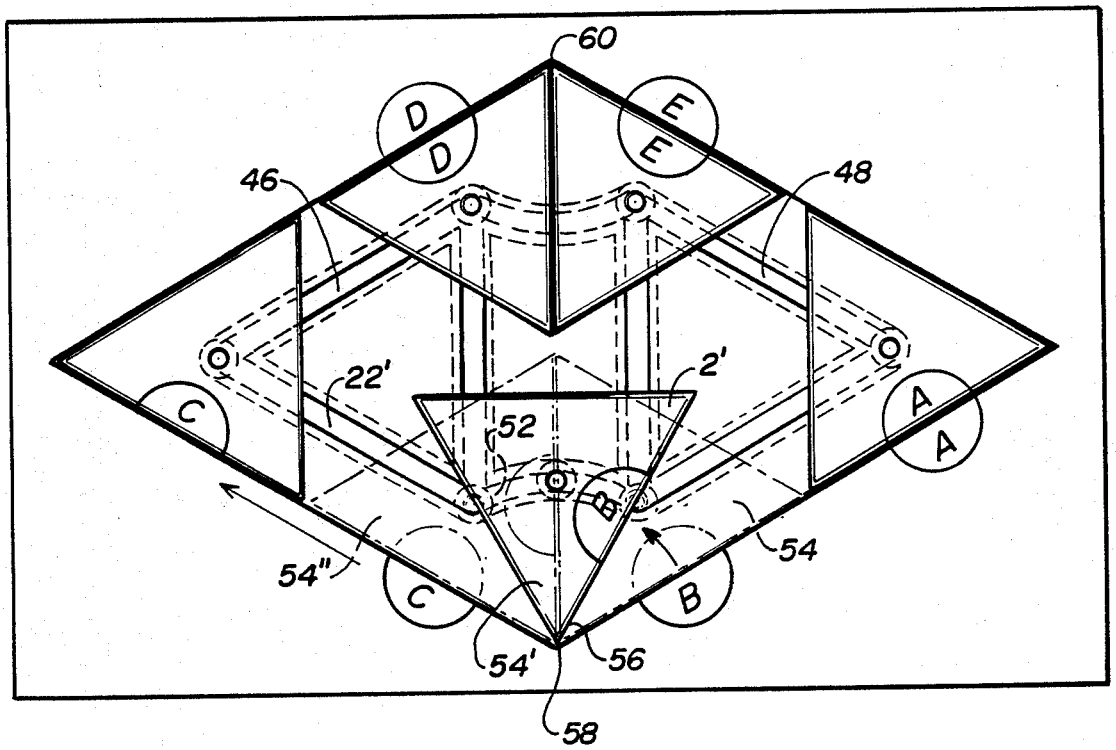
FIG. 7 is a top view, like FIG. 5, with the puzzle pieces arranged to show a puzzle piece in a rotational path of movement.

Referring to FIGS. 5–7, there is shown an alternative embodiment of the invention. A base 16' has a raised wall 18' with a groove pattern 22' and groove cross-section 14', the same as the first embodiment of FIGS. 1,2 and 4. The puzzle pieces 2' have a post 8' to engage the groove cross-section 14'. However, the puzzle pieces are triangular rather than square. Also the puzzle piece 2' does not have the cutout areas 6 at their three corners. The recessed area 20' is diamond shaped rather than rectangular. The pattern or series of grooves 22' is shaped as two triangular grooves 46,48 joined together at their bases by two curved grooves 50,52.

The post 8' of each puzzle piece 2' is in the groove pattern and the pieces 2' are capable of being moved within a plane back and forth along the grooves. The pieces 2' can move only along the straight grooves, but can move along, and rotate within the plane, when the post 8' of a puzzle piece 2' moves along the curved grooves 50,52. As shown in FIG. 7, a puzzle piece 2' will rotate 60 degrees when it moves from dotted line position 54 to solid line position 54' to dotted line position 54''. The rotation of 60 degrees is forced by one corner 56 of the puzzle piece 2' engaging the corner 58 or 60 of the wall of the recessed area so that the corner is retained while the post 8' moves from right to left along groove 52. A puzzle piece moving along the straight grooves will not rotate due to the walls of the recess and/or the sides of adjacent puzzle pieces preventing 60 degree rotation. Generally, the puzzle piece moves along the straight grooves back and forth along the grooves. The puzzle pieces 2' of FIGS. 5–7 are provided with a design similiar to that of the FIG. 1 embodiment by using semicircular designs A,B,C,D,E. A puzzle player uses the alternative embodiment of the invention in generally the same manner as the embodiment of FIG. 1.

What is claimed:

1. A single plane puzzle with movable pieces comprising:

(a) a base;

(b) said base having a wall structure around the perimeter of the base to form a recessed area, said recessed area having a base area and side walls formed by the wall structure;

(c) a pattern of connected grooves cut in the base area of the recessed area and the grooves being completely within the area surrounded by the side walls of the recessed areas;

(d) a plurality of puzzle pieces;

(e) said puzzle pieces being in a single plane in said recessed area and having means restraining the puzzle pieces for movement along the pattern of connected grooves and, at points, means as part of the puzzle forcing said puzzle pieces to rotate within the single plane; and (f) said puzzle pieces being provided with a design means providing the pieces with a desired pre-arranged relationship marked on their upper exposed surface whereby the puzzle pieces can be randomly moved to upset the pre-arranged relationship and then selectively moved to reform the desired pre-arranged relationship.

2. The single plane puzzle of claim 1 wherein:

(a) the puzzle pieces are square and some portion of the grooves are curved.

3. The single plane puzzle of claim 2 wherein:

(a) said puzzle pieces having an one quarter circle segment cutout below each corner thereof and the recessed area having raised semicircular one half circle segments adjacent the curved grooves whereby the raised semicircular segments engage the cutout areas to force the puzzle piece to rotate as it moves along the curved grooves.

4. The single plane puzzle of claim 1 wherein:

(a) the puzzle pieces are triangular and some portion of the grooves are curved.

5. The single plane puzzle of claim 4 wherein:

(a) said recessed area is diamond shaped and a corner of the puzzle piece is held in a corner of the recessed area near the curved grooves to force the puzzle piece to rotate as it moves along the curved grooves.

6. The single plane puzzle of claim 1 wherein:

(a) said means restraining the puzzle pieces is a post projecting into the grooves and said post having an enlarged end part to engage the grooves which have a cross-section providing an enlarged base region.

7. The single plane puzzle of claim 6 wherein:

(a) said enlarged end part and groove cross-section is a dovetail shape.

8. The single plane puzzle of claim 6 wherein:

(a) said enlarged end part and groove cross-section is an inverted T shape.

9. The single plane puzzle of claim 1 wherein:

(a) said means forcing rotation being in two parts, one part being on the puzzle pieces and the other part being in the recessed area of the base.

* * * * *